US007179976B2

(12) United States Patent
West

(10) Patent No.: US 7,179,976 B2
(45) Date of Patent: Feb. 20, 2007

(54) FINGERNAIL PICK FOR STRINGED INSTRUMENTS

(76) Inventor: John R. West, 15925 Birkhofer Rd., Guerneville, CA (US) 95446

( * ) Notice: Subject to any disclaimer, the term of this patent is extended or adjusted under 35 U.S.C. 154(b) by 203 days.

(21) Appl. No.: 10/917,417

(22) Filed: Aug. 13, 2004

(65) Prior Publication Data

US 2005/0066790 A1 Mar. 31, 2005

Related U.S. Application Data

(60) Provisional application No. 60/529,640, filed on Dec. 11, 2003, provisional application No. 60/495,287, filed on Aug. 14, 2003.

(51) Int. Cl.
*G10D 3/16* (2006.01)

(52) U.S. Cl. ..... 84/322

(58) Field of Classification Search ..... 84/320–322
See application file for complete search history.

(56) References Cited

U.S. PATENT DOCUMENTS

| | | | | |
|---|---|---|---|---|
| 3,650,172 A | | 3/1972 | Osborne | |
| 3,699,838 A | | 10/1972 | Montgomery | |
| 4,554,935 A | * | 11/1985 | Hokama | 132/73 |
| 4,625,616 A | * | 12/1986 | McVicker | 84/322 |
| 5,323,677 A | * | 6/1994 | Knutson | 84/322 |
| 5,413,123 A | * | 5/1995 | Aylott et al. | 132/73 |
| 5,638,835 A | * | 6/1997 | Franz et al. | 132/200 |
| 6,394,100 B1 | * | 5/2002 | Chang | 132/200 |
| 2003/0217758 A1 | * | 11/2003 | Mesirow | 132/73.5 |
| 2004/0005281 A1 | * | 1/2004 | Ohara | 424/61 |
| 2005/0217456 A1 | * | 10/2005 | Hodesh et al. | 84/322 |
| 2006/0016455 A1 | * | 1/2006 | Ide | 132/200 |

FOREIGN PATENT DOCUMENTS

| | | |
|---|---|---|
| DE | 34 29 620 A | 2/1986 |
| EP | 0 356 023 A2 | 2/1990 |
| WO | WO 02/31808 A1 | 4/2002 |

* cited by examiner

*Primary Examiner*—Gary F. Paumen
(74) *Attorney, Agent, or Firm*—Oliff & Berridge, PLC

(57) ABSTRACT

A fingernail pick that is removably attachable to a user's fingernail having a primary string contacting portion, an anchor portion which is shaped to fit comfortably and unobtrusively on top of the fingernail, and a mounting portion. The fingernail pick is held in place either by an adhesive, friction between a slot and a cantilevered portion of fingernail, or by a combination of the two. The fingernail pick may be formed in various sizes and shapes or available in custom sizes and shapes for particular users.

17 Claims, 9 Drawing Sheets

FINGERNAIL PICK FOR STRINGED INSTRUMENTS

This application claims priority from U.S. provisional Patent applications 60/495,287 filed on Aug. 14, 2003, and 60/529,640 filed on Dec. 11, 2003.

BACKGROUND OF THE INVENTION

1. Field of Invention

This invention relates to reusable picks for playing stringed instruments that are attachable to the fingernail of a user.

2. Description of Related Art

Musicians who play non-bowed string instruments (i.e., guitar, banjo, ukulele, harp etc.) may utilize one or more of five primary techniques for playing these instruments: 1) picking with a hand-held plectrum or pick; 2) picking with the fingertip; 3) picking with a combination of the fingertip and the fingernail; 4) picking with a thimble-type fingerpick that is slid over the end of one or more fingers on the picking hand; and 5) picking with a ring-type pick that wraps around one or more fingers or the thumb as in a typical thumb pick.

While many beginning finger-style players frequently use the bare fingertip, most advanced players, particularly on instruments or in situations where more volume is needed, learn to add some "natural nail" into the activation of the string because it strengthens and brightens the sound, prevents the tone from being "muddy", and in ensemble situations, allows the instrument to be heard when mixed with other instruments. However, musicians in the above mentioned situations are often plagued by broken or cracked fingernails. Several techniques and products have been introduced in response to these problems.

One such technique is nail strengthening that utilizes techniques that harden the nail. However, the problems associated with the nail hardening techniques include for example, the frequent, time consuming and costly application of chemicals and/or other ingredients; the difficulty of immediate repair of the nail if it is broken during a performance; the frequent filing of the nails in order to avoid the lack of continuity from one day to the next, in the exact shape, thickness, and size of the nail due to nail growth, accidental breakage, inaccurate and inconsistent filing; and the difficulty in applying products in the exact same manner in each application of the product.

Artificial nails are not suitable for musical performance because they are only suited for cosmetic purposes. Artificial nails are manufactured in accordance with size, shape and materials used, to be comfortable, simple to apply, and cosmetic. Therefore, the size, thickness and types of materials used for artificial nails are not suitable to withstand the rigors of musical performance without excessive breakage. In addition, artificial nails are also prone to wearing down, or coming off during a performance. Furthermore, the shape and materials used results in an unfavorable thin and "plastic-like" tone.

Although the use of fingerpicks reduce some of the problems associated with broken nails, these picks also have associated problems. For example, finger picks induce an uncomfortable and unnatural feeling, allow for striking of the string in only one direction, prevent substantial contact of the finger tip with the string, are difficult to learn to use, and, in the case of the most common thimble-type fingerpicks, require an unnatural and difficult clawing-type motion, as opposed to a simple and natural "rest stroke" motion, to activate the string of an instrument. Thimble-type picks, since they have no adhesive, require that the striking of the string also serves to push the thimble onto the finger, otherwise they would pop right off. Since this is true, the playing surface is angled upward which means that the picking motion requires curling the fingers almost all the way, similar to making a partially closed fist. This clawing type motion is very difficult to accomplish accurately and especially difficult to do quickly, unlike the "rest stroke" motion that is used in playing classical guitar where the rest stroke consists of a bending at the first knuckle which is much more natural and easy to do quickly. Additionally, such picks attached to the finger are not secure enough to stay in place during a performance of aggressive passages of music, have limited customizable options and are not compatible with advanced techniques such as "two hand tapping," in which both hands are used to hammer notes directly on the fingerboard of the instrument.

SUMMARY OF THE INVENTION

The present invention is a pick that is removably attachable to the user's fingernail. The fingernail pick includes a primary string contacting portion, which is the primary contact surface with a string of an instrument and which is shaped to optimize string activation; an anchor portion of the fingernail pick that is shaped to fit comfortably and unobtrusively on top of a portion of the non-cantilevered portion of the fingernail, or nail plate; and a mounting portion of the fingernail pick which provides a secure mounting of the pick to the fingernail.

In an exemplary preferred embodiment of the invention, a one-piece fingernail pick includes a mounting portion that has a molded slot portion to receive a cantilevered portion of the fingernail. The slot portion is formed such that the pick is held securely in place by a combination of friction between the fingernail and the slot portion and an adhesive which attaches the anchor portion to the nail plate. In other exemplary embodiments, the pick is held in place by friction between the fingernail and the slot alone. In still other exemplary embodiments, the pick is held in place by adhesive alone.

The fingernail pick of this invention, may further include specifically designed playing surfaces, i.e., the areas of the pick used to contact an instrument string. For example, the playing surfaces may have tapered slopes, which maximize the surface area of contact with the string, thereby improving the tone, increasing the volume and allowing for easier execution of fast passages of music. In another example, the playing surfaces may be tapered to an edge to emulate the sound of a fingernail. In an exemplary embodiment of the invention the fingernail pick may be customized to meet the exact playing surface and fitting requirements of the user.

An exemplary preferred embodiment of the invention includes a fingernail pick in which the primary string contacting portion is shaped to approximate the playing surfaces of a classical guitarist's fingernails which have been properly filed for performance. Another exemplary preferred embodiment of the invention includes a fingernail pick in which the primary string contacting portion is substantially longer and thicker than a fingernail to increase the playing surface and allow strokes in which the fingernail pick, and not the user's fingertip, strikes the string. Yet another exemplary embodiment of the invention includes a fingernail pick with a primary string contacting portion that is tilted in an upward direction from the plane of the user's fingernail to approximate the playing surface of a thimble-type finger pick. Another exemplary embodiment of the invention includes a fingernail pick that is worn approximately perpendicular to the line of the finger to which the fingernail pick is secured to approximate the playing surface of a thumb pick. Another exemplary preferred embodiment of the invention includes a fingernail pick with a slot disposed between the primary string contacting portion and the anchor portion which enables the primary string contacting portion to fit underneath a cantilevered portion of the fingernail.

In yet another exemplary embodiment, the fingernail pick is very thin and curved on an anchor portion of the fingernail pick to approximate the size and shape of the nail plate. The fingernail pick then gradually flattens towards the primary string contacting portion and playing surfaces of the fingernail pick. This shape aids in adhering the fingernail pick securely to the fingernail of the user, insures that a back edge of the pick does not catch on the string while strumming or picking downward, and optimizes contact of the fingernail pick with the string of the instrument.

The fingernail pick may be held in place by an adhesive, friction between a slot portion and a cantilevered portion of fingernail, or by some combination of the two. The fingernail pick is attached to the fingernail by aligning the fingernail pick with the fingernail of the user, sliding the cantilevered portion of the fingernail into the slot, if any, and pressing the fingernail pick firmly onto the fingernail of the user. The fingernail picks may be molded in various standard sizes and shapes or available in custom sizes and shapes for particular users. These and other features and advantages of various exemplary embodiments of materials and devices according to the invention are described in or apparent from, the following detailed description of the various exemplary embodiments according to this invention.

DETAILED DESCRIPTION OF PREFERRED EMBODIMENTS

Figure 1:
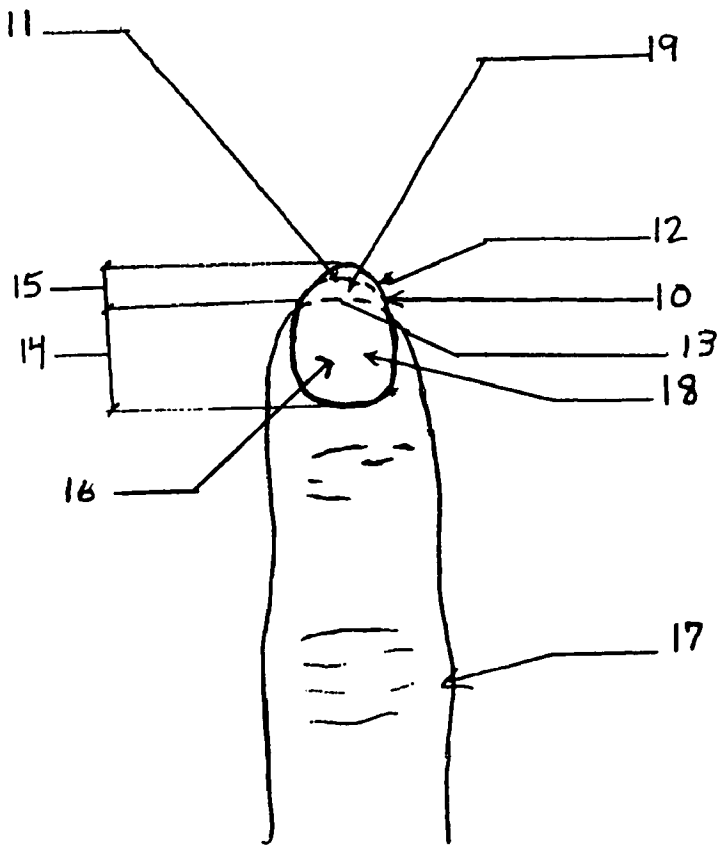
FIG. 1 is a top view of an exemplary embodiment of the invention.

FIG. 1 is a top view of an exemplary preferred embodiment of the invention. As shown in FIG. 1, the fingernail pick 10 is a single part that is attachable to the fingernail 18 of the user's finger 17. The fingernail pick 10 includes a primary string contacting portion 15, an anchor portion 14 and a mounting portion (not shown). A cantilevered portion 19 of the fingernail 18 is an extension of the nail from the front edge 13 of nail plate 16 (the nail plate 16 is completely covered by anchor portion 14 in FIG. 1 and is therefore not viewable).

In a preferred exemplary embodiment of the fingernail pick 10, the primary string contacting portion 15 approximates the size and shape of the cantilevered portion 19 of the fingernail 18. The primary string contacting portion 15 extends beyond the cantilevered portion 19 of the fingernail.

In an exemplary embodiment, the primary string contacting portion 15 is removable from the anchor portion 14 which allows the fingernail pick 10 to be customized according to the user's preferences of materials, playing style and desired tone and volume by replacing the primary string contacting portion 15.

The anchor portion 14 provides a base to stabilize the fingernail pick 10 when attached to the finger 17. The anchor portion 14 is disposed rearward of the primary string contacting portion 15 along the line of the pick 10. The anchor portion 14 at least partially covers a nail plate 16 and provides structural support to the primary string contacting portion 15. The anchor portion 14 may receive an adhesive to secure the fingernail pick 10 to the nail plate 16. In an exemplary embodiment the adhesive is applied to the underside of the anchor portion 14. In another exemplary embodiment the adhesive is applied to the nail plate 16. In an exemplary embodiment, the anchor portion 14 is made from a flexible material in order to conform to the nail plate 16. In another exemplary embodiment the anchor portion 14 is made from a thermoplastic or other heat-activated material that allows the anchor portion 14 to conform to the curvature of a nail plate 16. Thus, the anchor portion 14 may be customized to fit the nail plate 16. In yet another exemplary embodiment the anchor portion 14, the primary string contacting portion 15, and the slot portion 22, if any, are custom molded to conform to the fit and playing surface requirements of a particular user.

Figure 2:
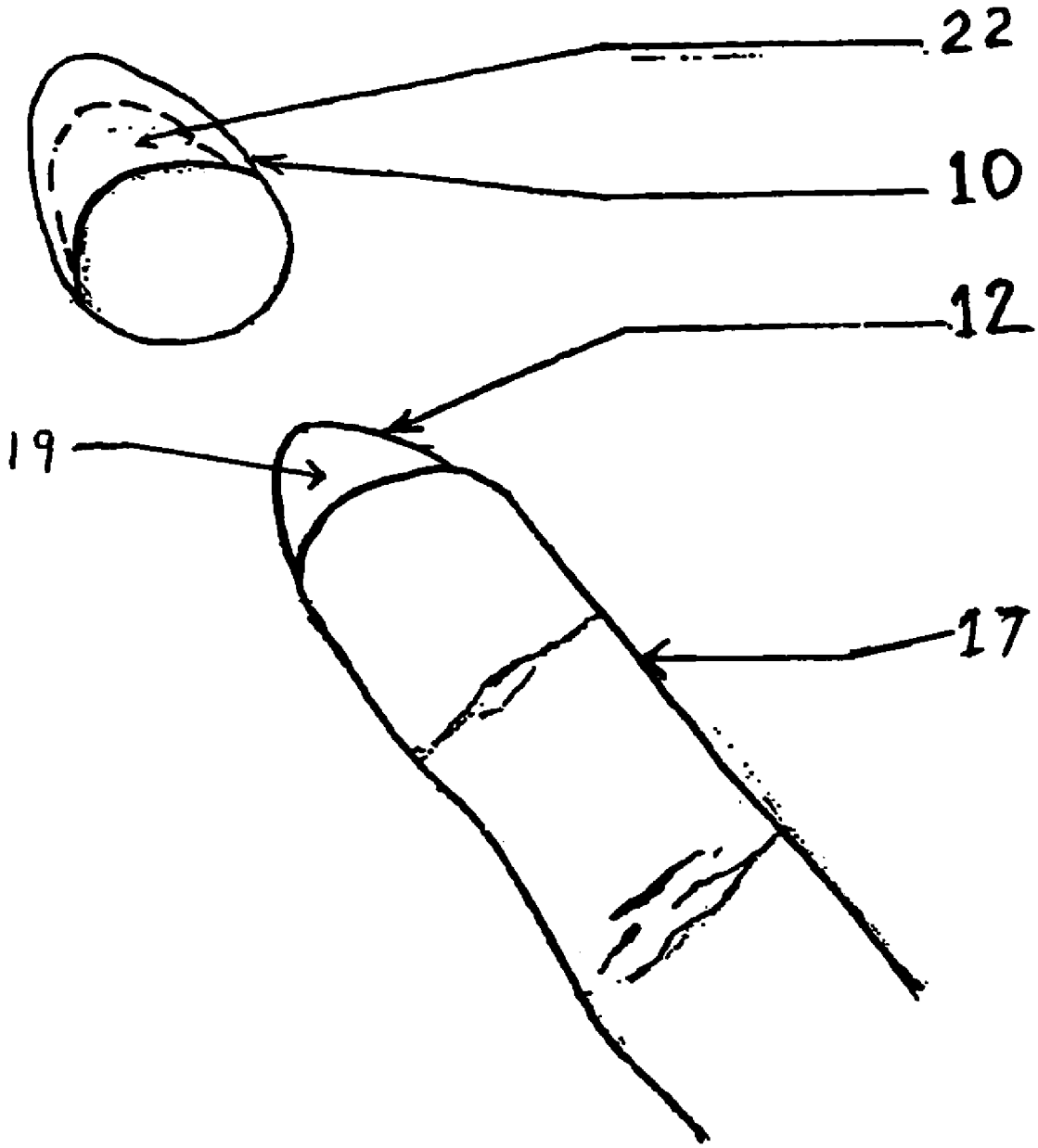
FIG. 2 is a bottom view of the embodiment shown in FIG. 1.

FIG. 2 is a bottom view of the embodiment shown in FIG. 1 and further shows a mounting portion 22. In an exemplary embodiment, the mounting portion 22 includes a formed slot portion of the fingernail pick 10. As shown in FIG. 2, the slot portion 22 is underneath the primary string contacting portion 15 of the fingernail pick 10. The slot portion receives the cantilevered portion 19 of the fingernail 18. In an exemplary embodiment, the slot portion 22 is molded by making an impression of the cantilevered portion 19 of the user's fingernail 18 in a thermoplastic or a similar material, which is disposed within the slot portion 22. By making an impression of the cantilevered portion 19 of the user's fingernail 18, the slot portion 22 is formed to encase and securely fit onto the cantilevered portion 19 of the fingernail 18 and secures the fingernail pick 10 to the fingernail 18 regardless of the length or condition of the cantilevered portion 19 of the fingernail 18. In another exemplary embodiment, the primary string contacting portion 15, the anchor portion 14, and the slot portion 22, if any, are reformable with a thermoplastic or similar material.

In another preferred embodiment the friction between the slot portion 22 and the cantilevered portion 19 of the fingernail 18 provides enough resistance to keep the pick 10 firmly secured into place without the use of any other adhesive or structure. Slot friction may be increased with textured inner surfaces or small teeth inside the slot. In an exemplary embodiment, the slot portion 22 can be combined with an adhesive that secures the anchor portion 14 to the nail plate 16. In another exemplary embodiment, the slot portion 22 can be filled with an adhesive to secure the fingernail pick 10 to the fingernail 18.

Figure 4:
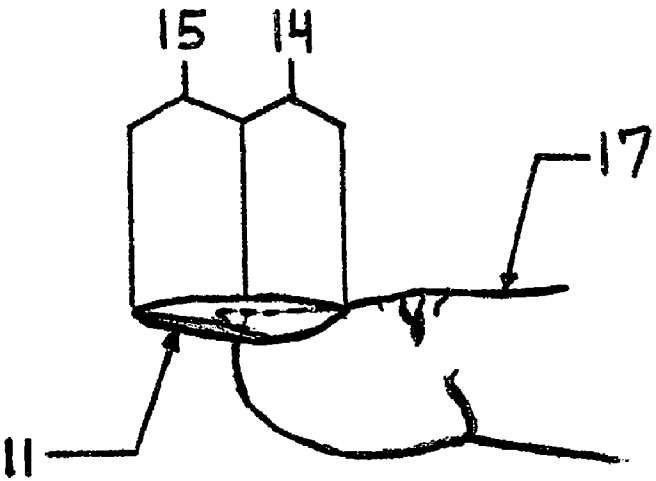
FIG. 4 is a side view of the embodiment shown in FIG. 3.
Figure 3:
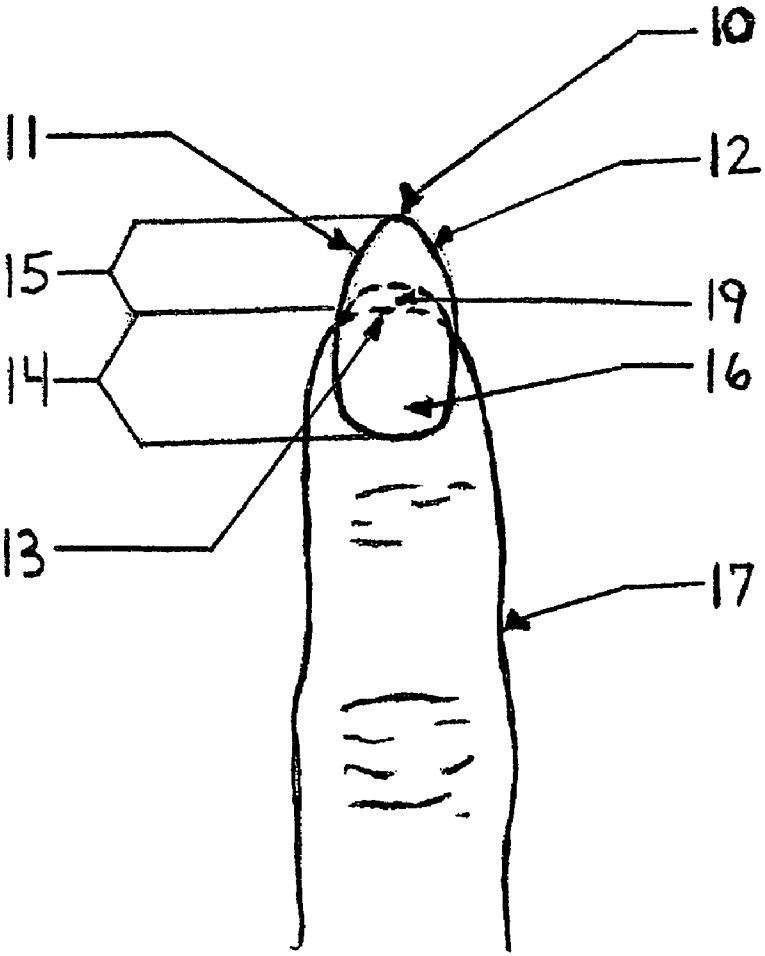
FIG. 3 is a top view of an exemplary embodiment of the invention.

FIG. 3 is a top view of an exemplary preferred embodiment of the invention and FIG. 4 is a side view of the embodiment shown in FIG. 3. As shown in FIGS. 3 and 4, the fingernail pick 10 comprises a primary string contacting portion 15, and anchor portion 14 which contacts a nail plate 16 (nail plate is completely covered by anchor portion 14 in FIG. 3 and is therefore not viewable). According to this embodiment the primary string contacting portion includes a primary playing surface 11 and a secondary playing surface 12. The primary playing surface 11 is the playing surface of the primary string contacting portion 15 that strikes an instrument string during an upstroke. The secondary playing surface 12 is the playing surface of the primary string contacting portion 15 that strikes an instrument string during a downstroke.

In an exemplary embodiment, the length of the primary string contacting portion 15 of the fingernail pick 10 is extended, for example, up to about ¼" beyond a normal length of the cantilevered portion 19 of the fingernail 18 when the cantilevered portion 19 of the fingernail 18 is optimally filed for playing a string instrument.

According to this embodiment, the fingernail pick 10 is a single piece that is attachable to the fingernail 18 of the user's finger 17. The fingernail pick 10 adheres to and covers the fingernail 18 of the user, regardless of the length of a cantilevered portion 19 of the fingernail 18. For example, if there is at least some cantilevered portion 19, then a lesser amount of adhesive is required on the underside of the anchor portion 14. If there is an insufficient cantilevered portion 19 present, then a greater amount of adhesive is required on the underside of the anchor portion 14 to secure the fingernail pick 10 to the user's finger 17.

According to this embodiment, the primary string contacting portion 15 approximates a size and shape of a typical plectrum and extends beyond the cantilevered portion 19 of the fingernail 18. In an exemplary embodiment, the primary playing surface 11 is tapered in a first direction relative to the plane of the primary string contacting portion 15, in a manner that increases the surface area of the primary playing surface 11. The secondary playing surface 12 is tapered in a second direction that is opposite of the first direction in a manner that increases the surface area of the secondary playing surface.

In an exemplary embodiment of the invention the primary playing surface 11 and the secondary playing surface 12 are tapered at angles ranging from about 30°–45°. These angles allow for greater tonal variety than a fingernail pick without such angles. The thickness of the fingernail pick 10 according to this embodiment ranges from about 1/32" to 3/16" and is otherwise substantially thicker than a fingernail. By controlling the range of thickness, the volume and fullness of the tone produced by the instrument may be variably selected. The thickness of the fingernail pick will also change depending on the material used to form the fingernail pick 10. Thus, the thickness along the primary playing surface 11 may be thicker than at any other portion of the pick 10.

Figure 6:
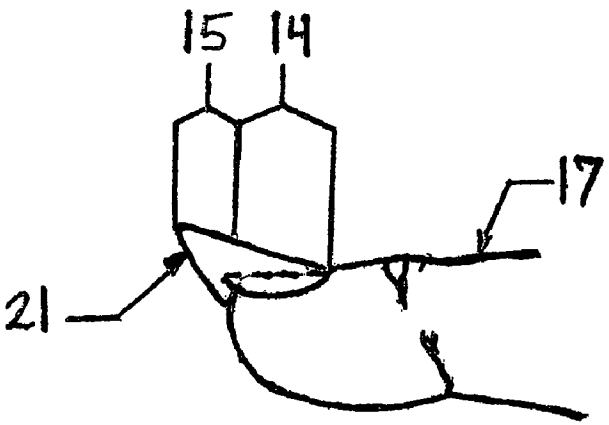
FIG. 6 is a side view of the embodiment shown in FIG. 5.
Figure 5:
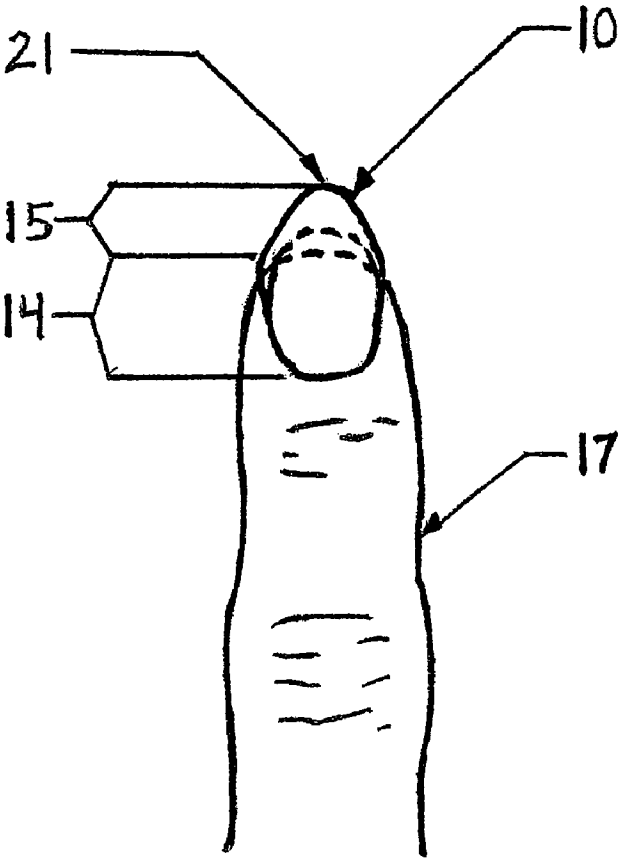
FIG. 5 is a top view of an exemplary embodiment of the invention.

FIG. 5 is a top view of an exemplary embodiment of the invention and FIG. 6 is a side view of the embodiment shown in FIG. 5. FIGS. 5 and 6 show a fingernail pick 10 including a primary string contacting portion 15, and anchor portion 14 disposed rearward from the primary string contacting portion, and a primary playing surface 21.

According to this embodiment the primary string contacting portion 15 and the primary playing surface 21 of the fingernail pick 10 are tiltable in an upward direction relative to the plane of the primary string contacting portion 15 of the fingernail pick 10 as indicated by the broken line in FIG. 6. According to this embodiment, the primary string contacting portion 15 and primary playing surface 21 are tiltable in a manner and degree that increases the surface area of the primary playing surface 21 such that the surface area and shape of the primary playing surface 21, approximates the surface area and shape of a thimble-type pick.

According to this embodiment, the thickness of the fingernail pick 10 along the primary playing surface 21 is thicker than at any other portion of the fingernail pick 10, while the anchor portion 14 is relatively thin by comparison, to prevent inadvertently catching the fingernail pick 10 on a string of the instrument being played.

In an exemplary embodiment, the primary playing surface 21 is thinner than shown in FIG. 6 and is turned upward at an angle that is pre-selected by the user and extends above the plane of the fingernail 18. For example, the angular degree of the tilt relative to the plane of the fingernail pick 10, may be pre-selected by the user to best compliment the user's particular playing style, physical requirements, etc. In a preferred exemplary embodiment, the primary playing surface 21 is triangular when viewed from the front end of the fingernail pick 10.

In a preferred embodiment, the upwardly tiltable pick 10 further comprises a slot portion as shown in FIG. 2 that is underneath the primary string contacting portion 15 and is formed to encase the cantilevered portion 19 of the fingernail 18 for removable attachment thereto. The fingernail pick 10 described in this embodiment is attached to the user's finger as described in the previous embodiments. In another embodiment, the upwardly tiltable pick 10 further comprises a mounting portion with a slot portion 22 and an adhesive layer between the anchor portion 14 and the nail plate 16.

Figure 8:
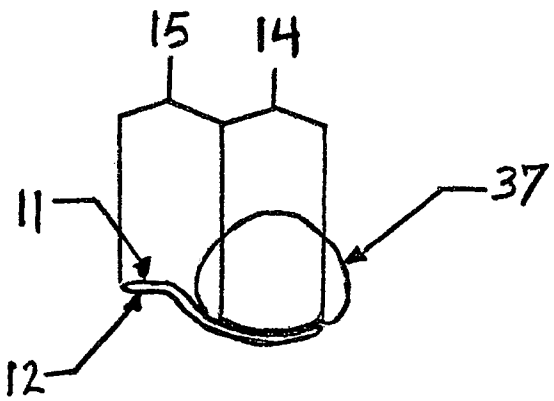
FIG. 8 is a side view of the embodiment shown in FIG. 7.
Figure 7:
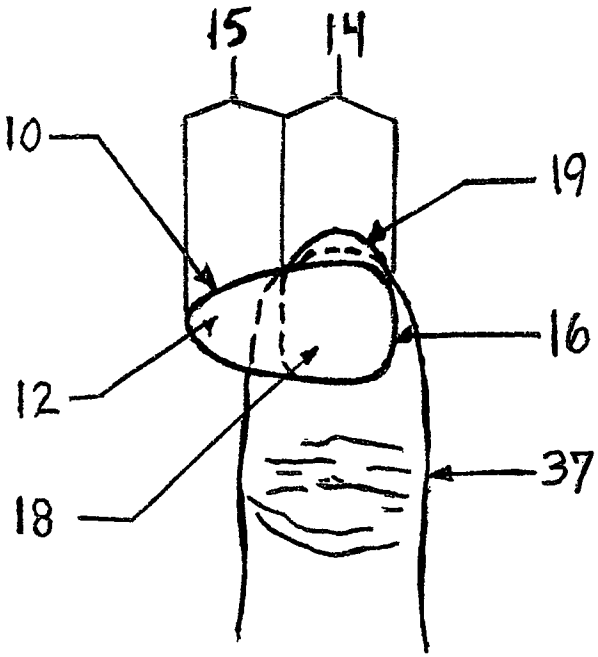
FIG. 7 is a top view of an exemplary embodiment of the invention.

FIG. 7 shows an exemplary embodiment of the fingernail pick 10 that is attached to a thumb nail 18 of the thumb 37 and is rotated at an angle to a line parallel to the thumb 37 and FIG. 8 is a side view of the embodiment shown in FIG. 7. The fingernail pick 10 includes a primary string contacting portion 15, and an anchor portion 14 that is disposed rearward from the primary string contacting portion 15.

As shown in FIGS. 7 and 8, in this embodiment, the fingernail pick 10 is fitted onto the thumb nail 18 with the anchored portion 14. The fingernail pick 10 covers the nail plate 16, but is not attached by the cantilevered section 19 of the user's fingernail 18. Attachment of the fingernail pick 10 is accomplished by an adhesive layer (not shown) that is received underneath the anchor portion 14. In another exemplary embodiment the rotated fingernail pick 10 further includes a slot for insertion of the cantilevered portion of the fingernail 19. In yet another exemplary embodiment the rotated fingernail pick 10 includes a slot for insertion of the cantilevered portion of fingernail 19, but is attached by friction between the slot and the fingernail only, without the need for adhesive or any other structure.

The primary playing surface 11 is the playing surface of the pick that strikes an instrument string during a downstroke. The secondary playing surface 12 is the playing surface of the pick 10 that strikes an instrument string during an upstroke. The primary playing surface 11 is on the opposite side of the secondary playing surface 12. According to this exemplary embodiment of the fingernail pick 10, the surface area and shape of the fingernail pick 10 approximates the surface area and shape of a thumb pick.

Figure 9:
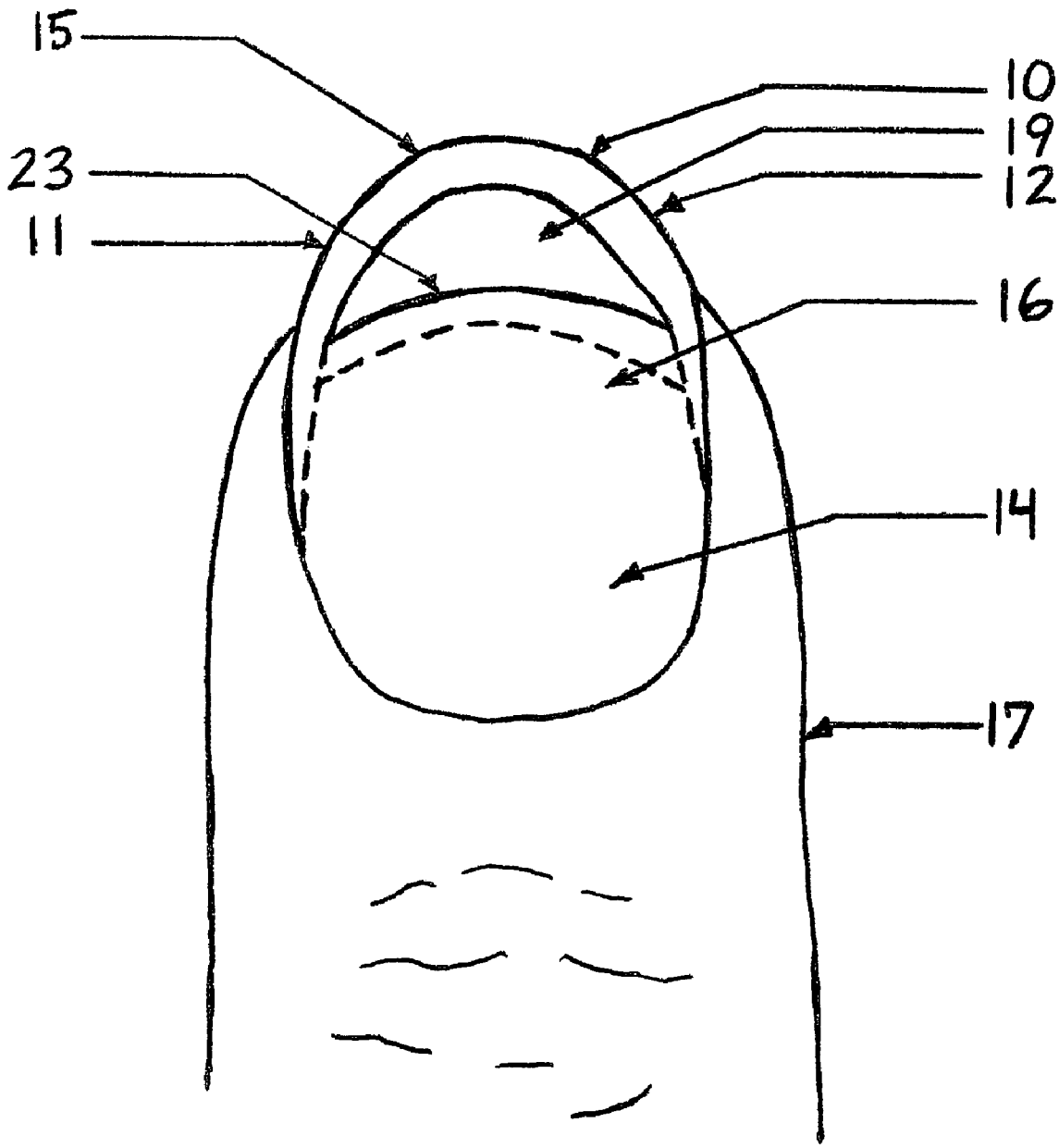
FIG. 9 is a top view of an exemplary embodiment of the invention.
Figure 10:
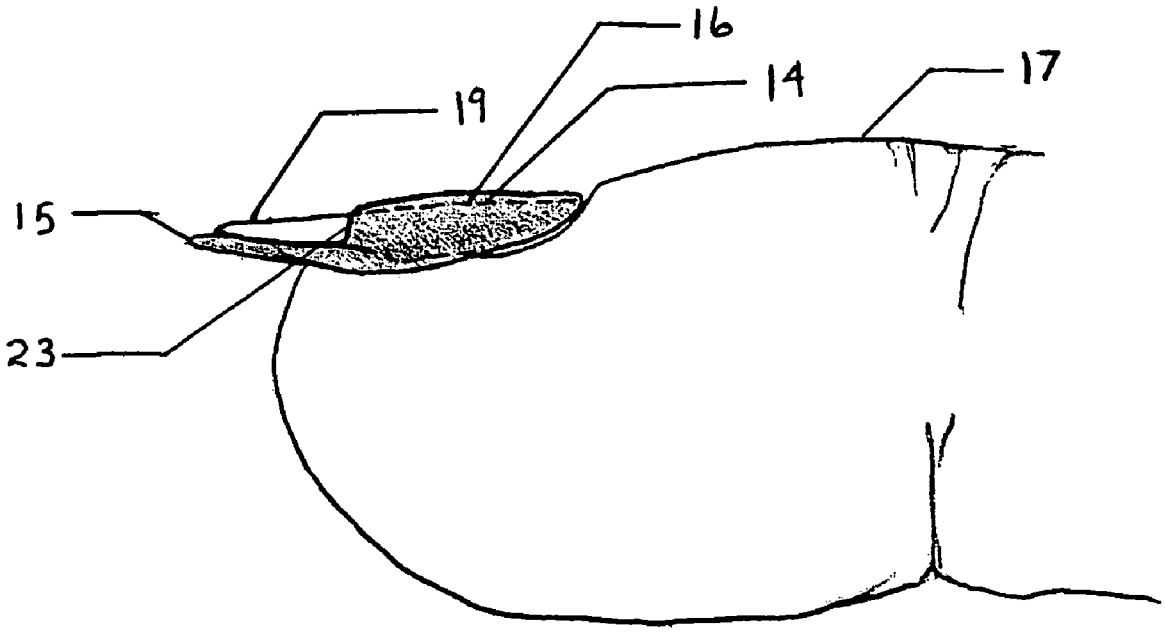
FIG. 10 is a side view of the embodiment shown in FIG. 9.

FIG. 9 depicts a top view of an exemplary embodiment and FIG. 10 is a side view of the embodiment shown in FIG. 9. As shown in FIGS. 9 and 10 according to this embodiment, the fingernail pick 10, comprises a primary string contacting portion 15, an anchor portion 14 that is disposed rearward of the primary string contacting portion 15, and a mounting portion which includes a slot portion 23 and an adhesive layer (not shown) between the anchor portion 14 and the nail plate 16. According to this embodiment of the fingernail pick 10, the slot portion 23 is disposed between the anchor portion 14 and the primary string contacting portion 15. The slot portion 23 enables the primary string contacting portion 15 to fit underneath a cantilever portion 19 of the fingernail 18. In an exemplary embodiment, the mounting portion further comprises an additional adhesive layer between the cantilevered portion of fingernail 19 and the primary string contacting portion 15. For example, the amount of adhesive received by the anchor portion 14 and between the primary string contacting portion 15 and the cantilevered portion of fingernail 19 will depend on the length of the cantilever portion 19 of the fingernail 18. In an exemplary embodiment of the fingernail pick 10, the primary string contacting portion 15 further comprises a primary playing surface 11 and a secondary playing surface 12.

Figure 11:
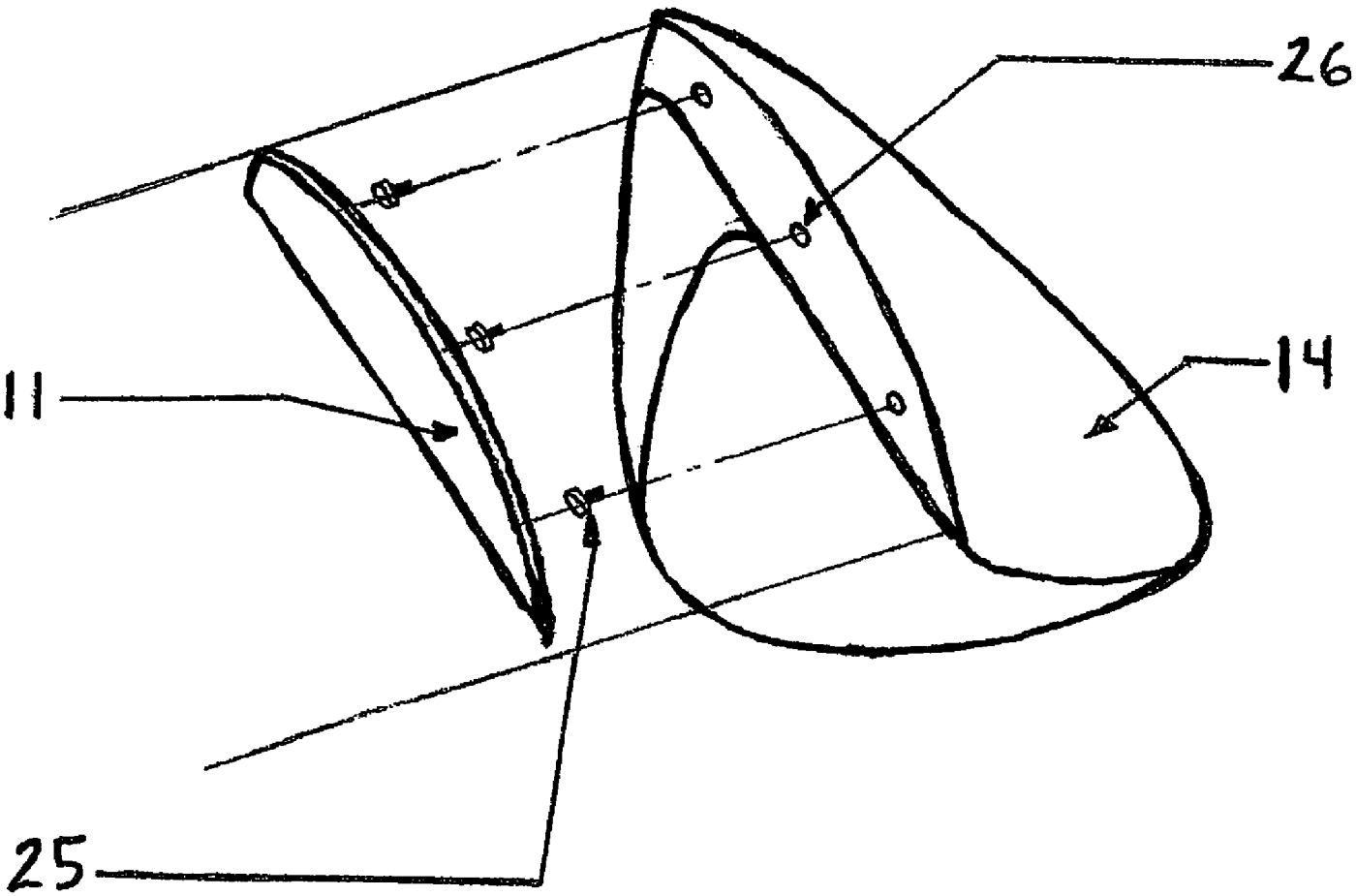
FIG. 11 is an example of a replaceable playing surface.

FIG. 11 is an exemplary embodiment of the fingernail pick 10 that shows a primary string contacting portion 15 that includes a replaceable playing surface 11.

According to this embodiment, the primary string contacting portion 15 includes at least one replaceable playing surface 11. In an exemplary embodiment, the playing surfaces 11 are disposed along the sides of the primary string contacting portion 15. In an exemplary embodiment, the replaceable playing surface 11 is attached to the primary string contacting portion 15 by fastener portions 25 that are inserted into fitted holes 26 disposed on the primary string contacting portion 15. The fastener portions 25 and fitted holes 26 allow for removable attachment of the playing surface 11 to the primary string contacting portion 15. In an exemplary embodiment, the replaceable playing surface 11 is attached to the primary string contacting portion 15 by an adhesive, or, by a combination of adhesive and/or fastener portions 25.

According to this embodiment, the replaceable playing surface 11 allows for the interchange of different types of playing surfaces. For example, playing surfaces made from different materials could be used to change the volume, tone or timbre of the instrument. Examples of different materials that could be used as the playing surface 11 include, but are not limited to, various plastics, thermoplastics, glass, graphite, ceramics, fiberglass, resin, animal products, plant material, metal, wood or stone.

Figure 12:
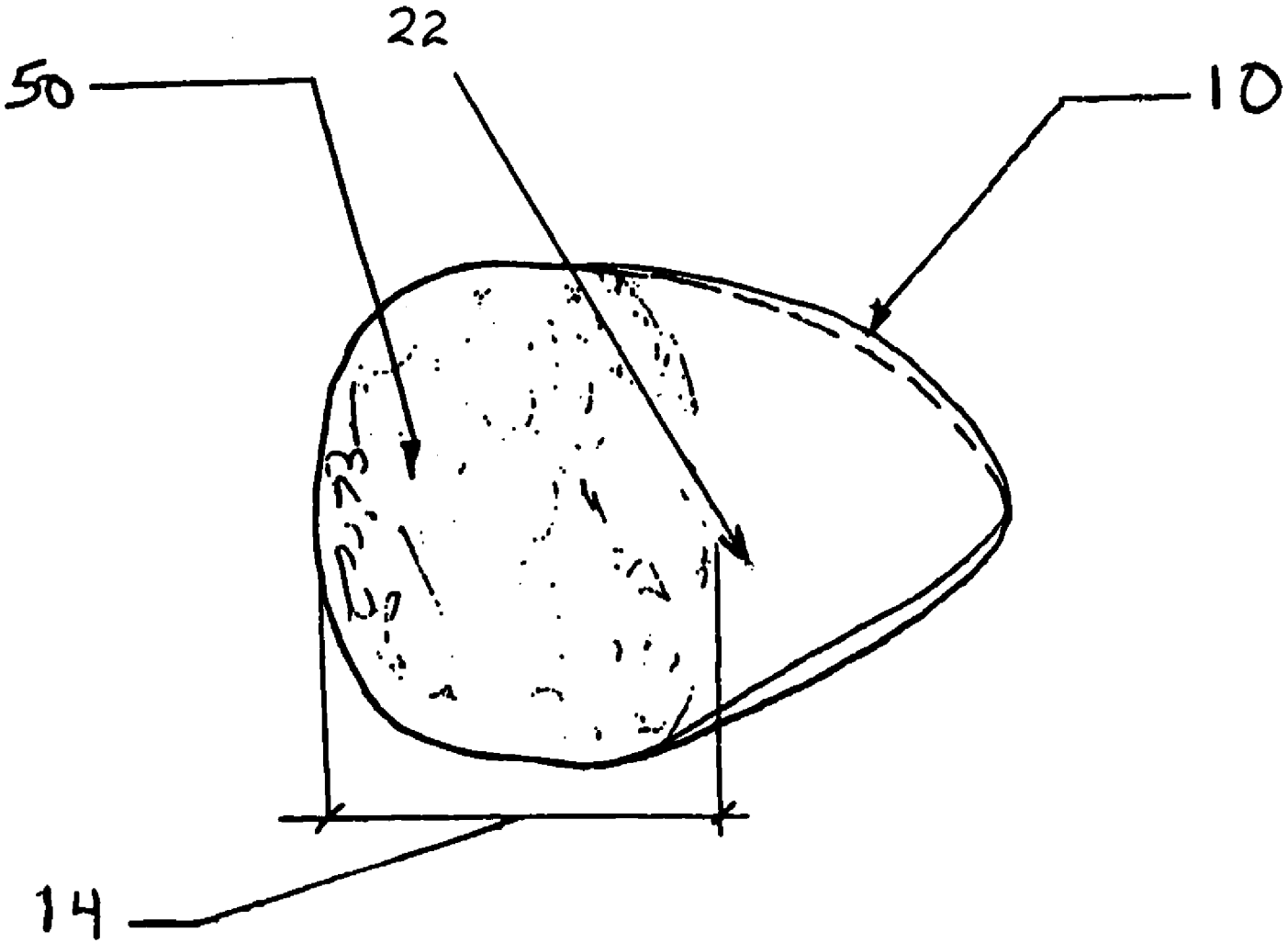
FIG. 12 shows an adhesive layer of a fingernail pick.

FIG. 12 shows a mounting portion including an adhesive layer 50 and a slot portion 22 of the fingernail pick 10. In an exemplary embodiment, the adhesive layer 50 is used alone to secure the fingernail pick 10 to the fingernail 18. In another embodiment, the adhesive layer 50 is used in conjunction with either a formed slot portion 22 or a formed open slot portion 23, to secure the pick 10, to the fingernail 18. In yet another embodiment, the adhesive layer 50 is used in conjunction with either a formable slot portion 22 or a formable open slot portion 23, to secure the pick 10, to the fingernail 18.

For example, the adhesive 50 is a pressure-sensitive adhesive and the anchor portion 14 of the fingernail pick 10 is textured such that the pressure-sensitive adhesive will pull away from the fingernail 18 before pulling away from the fingernail pick 10. The pressure-sensitive adhesive can be reactivated by soaking the fingernail pick 10 in warm water. In other examples, the adhesive is a pre-applied adhesive with a backing. For example, a double-sided adhesive. Another example of the adhesive layer is a user-applied adhesive such as hot melt, nail glue, cyanoacrylate, miniature Velcro, epoxy and the like. Although various adhesives are discussed in the above embodiments, those of ordinary skill in the art will understand that other adhesives may be used in conjunction with this invention.

In other exemplary embodiments of the present invention, the fingernail pick can be manufactured from moldable and non-moldable materials, including but not limited to, urethane, various plastics, thermoplastics, graphite, glass, ceramics, fiberglass, resin, animal products, plant material, wood, bone, carbon fiber, stone and metal. Although various materials are discussed in the above embodiments, those of ordinary skill in the art will understand that other materials may be used in conjunction with this invention.

While the above describes what are presently believed to be the preferred embodiments of the invention, those skilled in the art will realize that various changes and modifications may be made to the invention without departing from the spirit and scope of the present invention. For example, the fingernail pick could be made in different colors and custom designs, and is adaptable for right hand fingernails and left hand fingernails or generic shapes that accommodate both the right hand or the left hand. In addition, while many different methods of manufacturing are applicable to the invention, a preferred method includes use of an injection molding process to produce certain standard sizes of picks. A second method would include use of an injection molding process to produce certain standard sizes of picks and then a machining process to create picks whose physical shape is a subset of an injected molded pick. Thus, more sizes and shapes of picks can be manufactured without needing expensive molds for every different shape and size.

What is claimed is:

1. A prosthetic fingernail pick for playing a stringed instrument having a plurality of strings, comprising:

a primary string contacting portion for causing at least one of the plurality of strings to vibrate, the primary string contacting portion having an upper surface and a lower surface;

an anchor portion disposed rearward of the primary string contacting portion that at least partially covers a nail plate of a fingernail and provides structural support to the primary string contacting portion as the primary string contacting portion contacts the plurality of strings; and a mounting portion that is attachable to the fingernail, wherein the mounting portion is located below the upper surface of the primary string contacting portion, wherein the mounting portion includes a formed slot portion disposed between the primary string contacting portion and the anchor portion and extending substantially across the width of the prosthetic fingernail pick to receive a cantilevered portion of the fingernail for removable attachment thereto, and the mounting portion is removably adhered to the fingernail without any other supporting structure to secure the prosthetic fingernail pick to the fingernail.

2. The prosthetic fingernail pick according to claim 1, wherein at least one of the primary string contacting portion and a playing surface are replaceable.

3. The prosthetic fingernail pick according to claim 1, wherein the primary string contacting portion extends beyond a cantilevered portion of the fingernail.

4. The prosthetic fingernail pick according to claim 1, wherein the primary string contacting portion is tiltable in an upward direction from a plane of the fingernail.

5. The prosthetic fingernail pick according to claim 1, wherein the primary string contacting portion extends at an angle to a line parallel to a finger.

6. The prosthetic fingernail pick according to claim 1, wherein the anchor portion comprises a flexible material conformable to a nail plate.

7. The prosthetic fingernail pick according to claim 1, wherein the anchor portion is reformable to a shape of a nail plate.

8. The prosthetic fingernail pick according to claim 1, wherein the mounting portion receives an adhesive layer on an underside of the anchor portion.

9. The prosthetic fingernail pick according to claim 1, wherein the primary string contacting portion is re-formable.

10. The prosthetic fingernail pick according to claim 1, wherein the pick is made from at least one of plastic, thermoplastic, graphite, resin, epoxy, ceramic, fiberglass, animal product, plant material, wood, carbon fiber, glass, bone, shell, stone, and metal.

11. The prosthetic fingernail pick according to claim 1, wherein the primary string contacting portion is located beneath a cantilevered portion of the fingernail, and the mounting portion includes a slot disposed between the primary string contacting portion and the anchor portion into which the cantilevered portion of the fingernail is received.

12. The prosthetic fingernail pick according to claim 11, wherein the mounting portion receives an adhesive layer on the underside of the anchor portion.

13. The prosthetic fingernail pick according to claim 11, wherein the mounting portion receives a first adhesive layer on an underside of the anchor portion and a second adhesive layer disposed between the primary string contacting portion and the cantilevered portion of the fingernail.

14. A prosthetic fingernail pick for playing a stringed instrument having a plurality of strings, comprising:

a primary string contacting portion for causing at least one of the plurality of strings to vibrate, the primary string contacting portion having an upper surface and a lower surface, wherein the primary string contacting portion is disposed beneath and extending beyond a cantilevered portion of a fingernail;

an anchor portion that at least partially covers a nail plate of the fingernail and attaches the primary string contacting portion to the nail plate as the primary string contacting portion contacts the plurality of strings, wherein the anchor portion is attachable to the nail plate with an adhesive layer; and a slot portion located between the primary string contacting portion and the anchor portion and extending substantially across the width of the prosthetic fingernail pick into which the cantilevered portion of the fingernail is inserted, wherein the anchor portion is adhered to the fingernail without any other supporting structure to secure the pick to the fingernail.

15. A prosthetic fingernail pick for playing a stringed instrument having a plurality of strings, comprising:

a primary string contacting portion for causing at least one of the plurality of strings to vibrate, the primary string contacting portion having an upper surface and a lower surface;

an anchor portion disposed rearward of the primary string contacting portion that at least partially covers a nail plate of a fingernail and provides structural support to the primary string contacting portion as the primary string contacting portion contacts the plurality of strings; and a mounting portion that is attachable to the fingernail, wherein the mounting portion is located below the upper surface of the primary string contacting portion and includes a formed slot portion disposed between the primary string contacting portion and the anchor portion and extending substantially across the width of the prosthetic fingernail pick to receive a cantilevered portion of the fingernail, wherein the mounting portion is removably adhered to the fingernail without any other supporting structure to secure the prosthetic fingernail pick to the fingernail, wherein the primary string contacting portion extends beyond the cantilevered portion of the fingernail, and wherein the primary string contacting portion further comprises a primary playing surface along a first side of the primary string contacting portion, and a secondary playing surface along a second side of the primary string contacting portion, wherein the primary playing surface and the secondary playing surface are tapered.

16. The prosthetic fingernail pick according to claim 15, wherein the mounting portion receives an adhesive layer on the underside of the anchor portion.

17. The prosthetic fingernail pick according to claim 15, wherein the formed slot portion is reformable.

* * * * *